United States Patent [19]

Huerto et al.

[11] Patent Number: 4,785,939

[45] Date of Patent: Nov. 22, 1988

[54] STACKING TRAY

[75] Inventors: Robert R. Huerto, Long Beach; Cory A. Saulsberry, Lomita, both of Calif.

[73] Assignee: Eldon Industries, Inc., Inglewood, Calif.

[21] Appl. No.: 54,375

[22] Filed: May 26, 1987

[51] Int. Cl.[4] ..... B65D 21/02

[52] U.S. Cl. ..... 206/511; 108/111; 211/11; 211/126

[58] Field of Search ..... 108/111; 206/503, 511, 206/558; 211/11, 126, 128, 133

[56] References Cited

U.S. PATENT DOCUMENTS

| | | | |
|---|---|---|---|
| 1,957,153 | 5/1934 | Smiley, Jr. | 211/126 |
| 2,349,385 | 5/1944 | Snelling | 211/126 |
| 2,456,929 | 12/1948 | Dee | 211/126 |
| 2,575,919 | 11/1951 | Kautzmann et al. | 211/126 |
| 3,480,154 | 11/1969 | Telfer | 211/126 |
| 3,482,708 | 12/1969 | Levit et al. | 211/126 |
| 3,533,512 | 10/1970 | Serwer | 211/126 |
| 3,584,744 | 6/1971 | Ettlinger, Jr. | 211/126 |
| 3,648,849 | 3/1972 | Harris et al. | 211/126 |
| 3,874,510 | 4/1975 | Perry et al. | 211/126 |
| 4,074,810 | 2/1978 | Juergens et al. | 211/11 |
| 4,099,472 | 7/1978 | Kellogg | 108/111 |
| 4,145,977 | 3/1979 | Yellin | 108/111 |
| 4,253,402 | 3/1981 | Carrig et al. | 211/126 |
| 4,353,470 | 10/1982 | Polhemus et al. | 211/126 |
| 4,441,615 | 4/1984 | Goodrich | 206/511 |
| 4,691,644 | 9/1987 | Frydman | 108/111 |

FOREIGN PATENT DOCUMENTS

| | | | |
|---|---|---|---|
| 0543014 | 2/1942 | United Kingdom | 206/503 |

*Primary Examiner*—Jimmy G. Foster

*Attorney, Agent, or Firm*—Edward D. O'Brian

[57] ABSTRACT

In a stacking tray combination of the kind containing a series of trays overlying one another in vertical spaced relationship and containing support means for holding said trays in that described position, the improvement is characterized by at least a portion of the support means comprising a hollow channel shaped member, which is connected to the side of a tray and which contains an open side portion; and by an insertable key means positioned within said channel shaped member, with said key means containing a key portion for linking said channel member within another portion of said support means; and with said key means further having a surface for closing the open side of said channel shaped member and together with that member simulating a thick solid post. In an additional aspect of the invention a cap is provided for covering the upper end of the channel member to add to the impression of solidness of form. And in still further aspect the key includes a flange that in turn defines a slot that is capable of receiving key portions of additional key means or the depending portion of the aforedescribed end cap.

13 Claims, 5 Drawing Sheets

STACKING TRAY

FIELD OF THE INVENTION

The invention relates to desk top paper trays and, more particularly, to an improved stacking tray of luxurious appearance.

BACKGROUND OF THE INVENTION

The desktop "In" basket and the associated "Out" basket in great part have been superseded as a desk accessory by stacking tray combinations. In those combinations two or more paper receiving trays are positioned in a vertical arrangement with one tray overlying the other. Stacks of three or four trays are not uncommon. In comparison to the use of multiple trays placed on different portions of the desk, the stacking tray has the obvious advantage of occupying a smaller portion of the desk, thereby allowing greater desk workspace. The space gained increases in proportion to the number of trays which one needs to accomplish ones deskwork. Accordingly, stacking trays have gained wide popularity.

Stacking trays have before now appeared in many forms. Wire baskets stacked by use of wire or rod supports; metal trays supported in vertical overlying relationship by means of brackets or bent wire rods; and plastic trays supported by plastic brackets are common and known. A visit to the local office supply store reveals a wide variety of available stacking trays, especially those made of plastic material, in a wide variety of shapes and colors.

Although the prior stacking tray structures are functionally acceptable, the requirements of the modern office include demands on the appearance of the accessory. Accessories should be eye appealing as well as functional. Thus a stacking tray that is designed well and presents a luxurious appearance may well be the first choice over other competitive models. It may also command a premium.

An object of the invention is thus to provide a plastic stacking tray combination that provides a sleek and luxurious appearance befitting use in a well appointed office. It is a further object of the invention to provide a stacking tray combination that is assembled easily from a variety of parts. It is another object of the invention to provide a stacking tray combination that may be easily packed in unassembled condition to minimize package size and, hence, storage space, and which thereafter may be easily assembled into its functional form. It is a still further object to provide a stacking tray combination in which the side posts supporting multiple trays in vertical relationship do not detract from the appearance of the accessory and enhance the overall design.

SUMMARY OF THE INVENTION

In a stacking tray combination of the kind containing a series of trays overlying one another in vertical spaced relationship and containing support means for holding said trays in that described position, the improvement of the invention is characterized by at least a portion of the support means comprising a hollow channel shaped member, which is connected to the side of a tray and contains an open side portion; an insertable key means is positioned within said channel shaped member, said key means containing a key portion for linking said channel member within another portion of said support means; and said key means further having a flat planar surface for closing the open side of said channel shaped member and together with that member simulating a thick solid post. In an additional aspect of the invention a cap is provided for covering the upper end of the channel member to add to the impression of solidness of form. And in a still further aspect the key includes a flange that defines a slot, and the slot is sized to receive key portions of additional key means or the depending portion of the aforedescribed end cap.

The foregoing objects and advantages of the invention together with the structure characteristic thereof, which was only briefly summarized in the foregoing passage, becomes more apparent to those skilled in the art upon reading the detailed description of a preferred embodiment of the invention, which follows in this specification, taken together with the illustrations thereof presented in the accompanying drawings.

BRIEF DESRIPTION OF THE DRAWINGS

Figure 1:
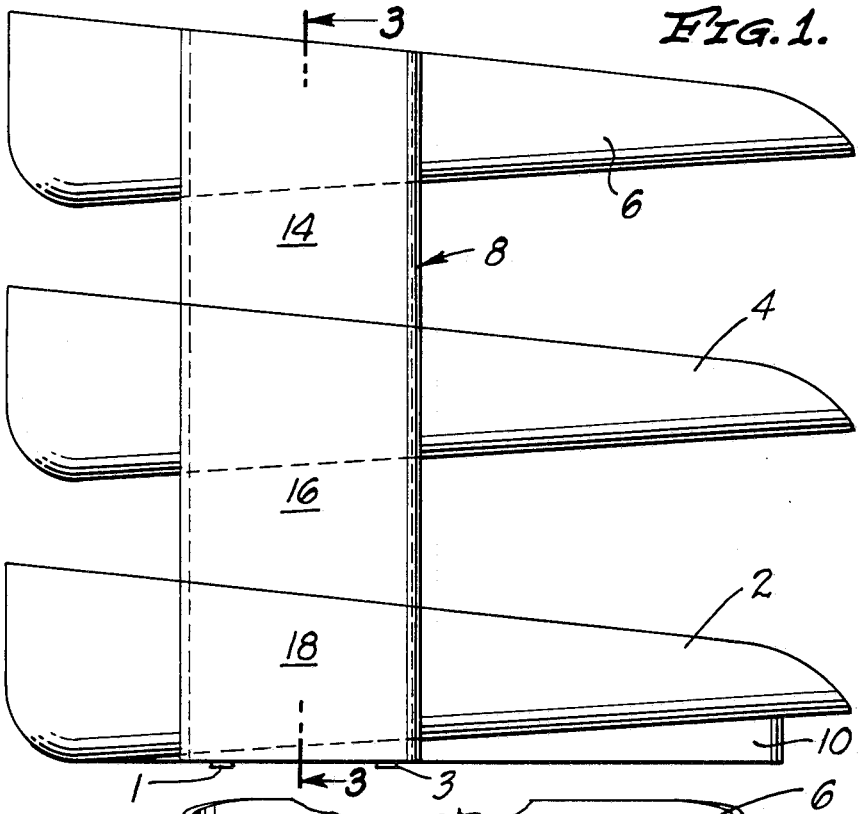
FIG. 1 is a side elevation view of the new stacking tray.
Figure 3:
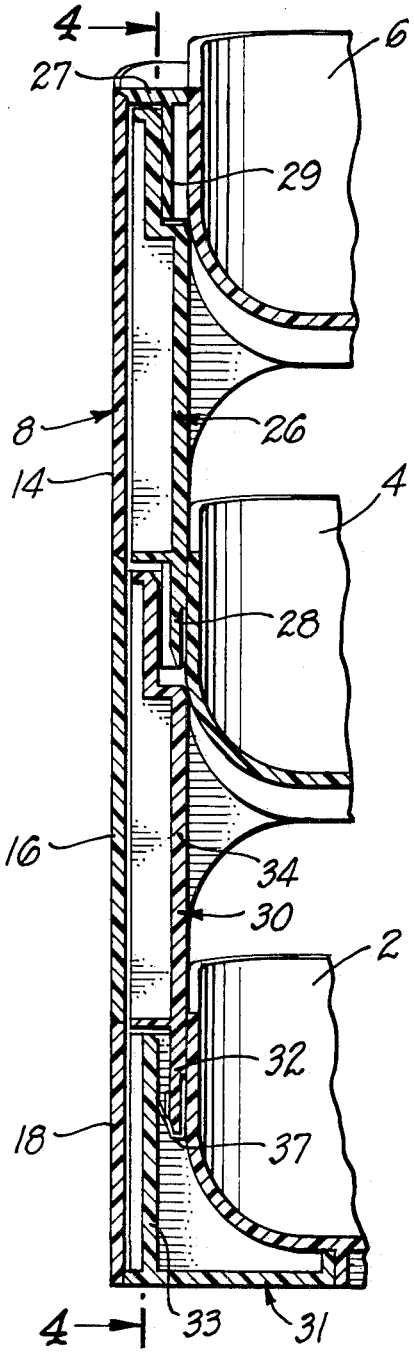
FIG. 3 is a partial section view of the embodiment illustrated to FIG. 1 taken along the section lines 3—3.
Figure 4:
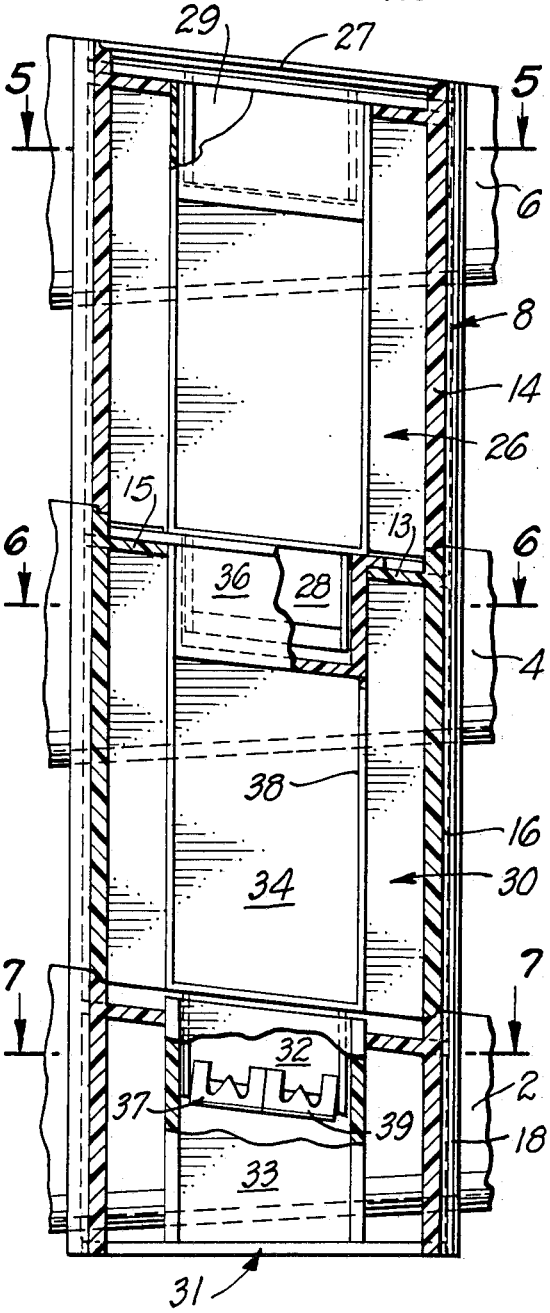
FIG. 4 is a partial section view of the invention taken along the section lines 4—4 in FIG. 3.
Figure 5:
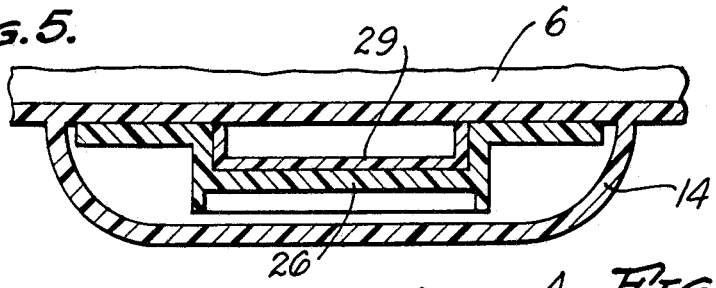
Figure 6:
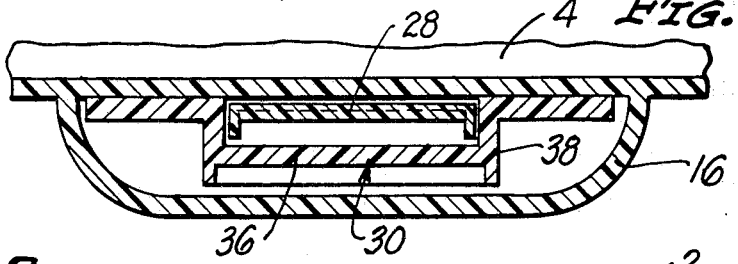
Figure 7:
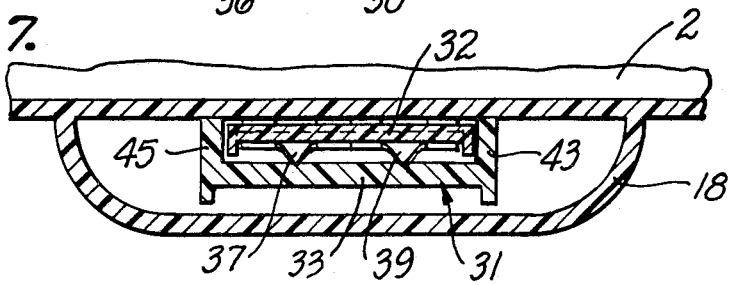
Figure 8:
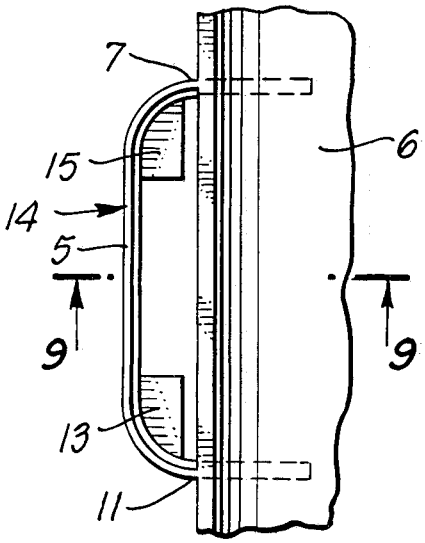
Figure 9:
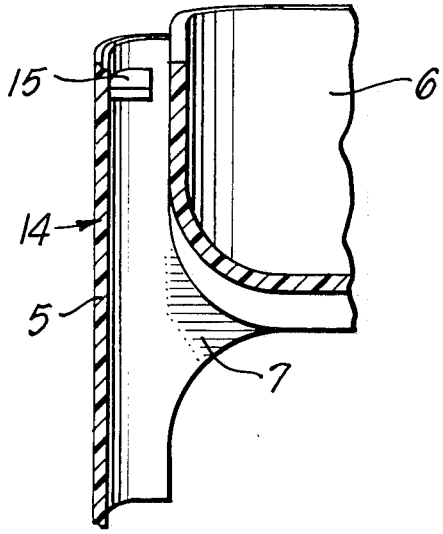
Figure 10:
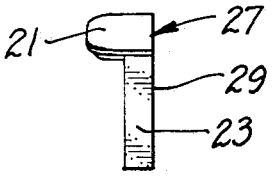
Figure 11:
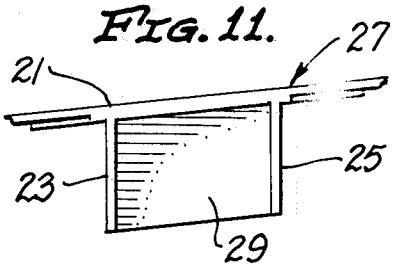
Figure 12:
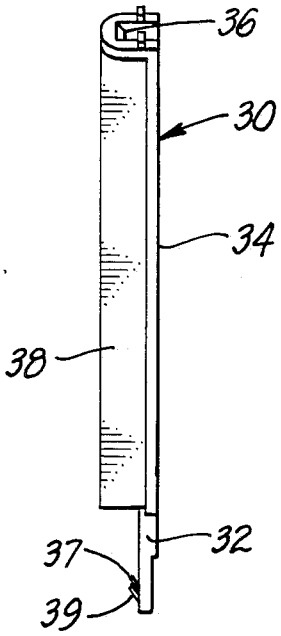
Figure 13:
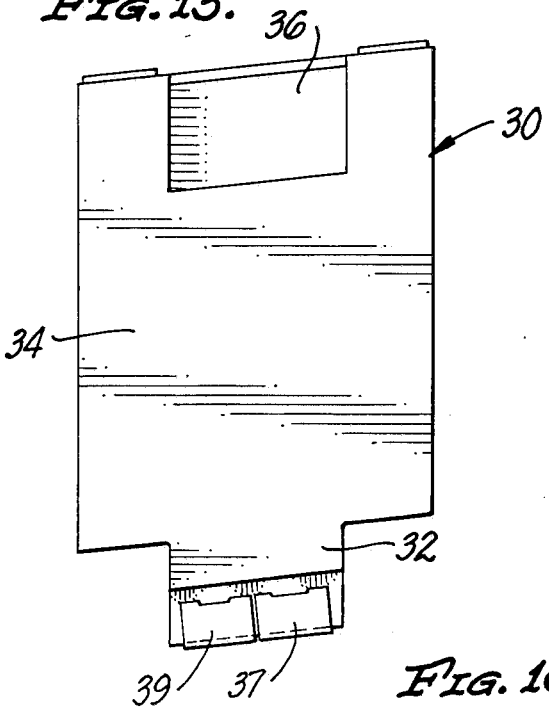
Figure 16:
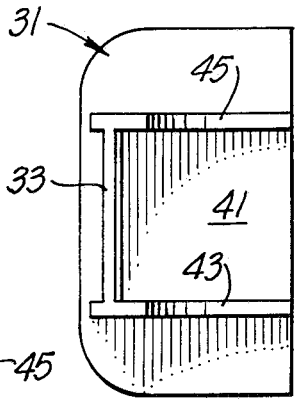
Figure 14:
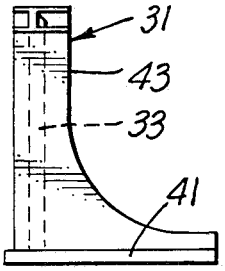
Figure 15:
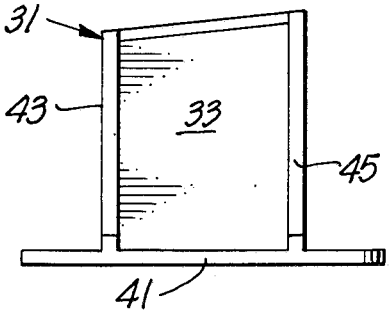
Figure 17:
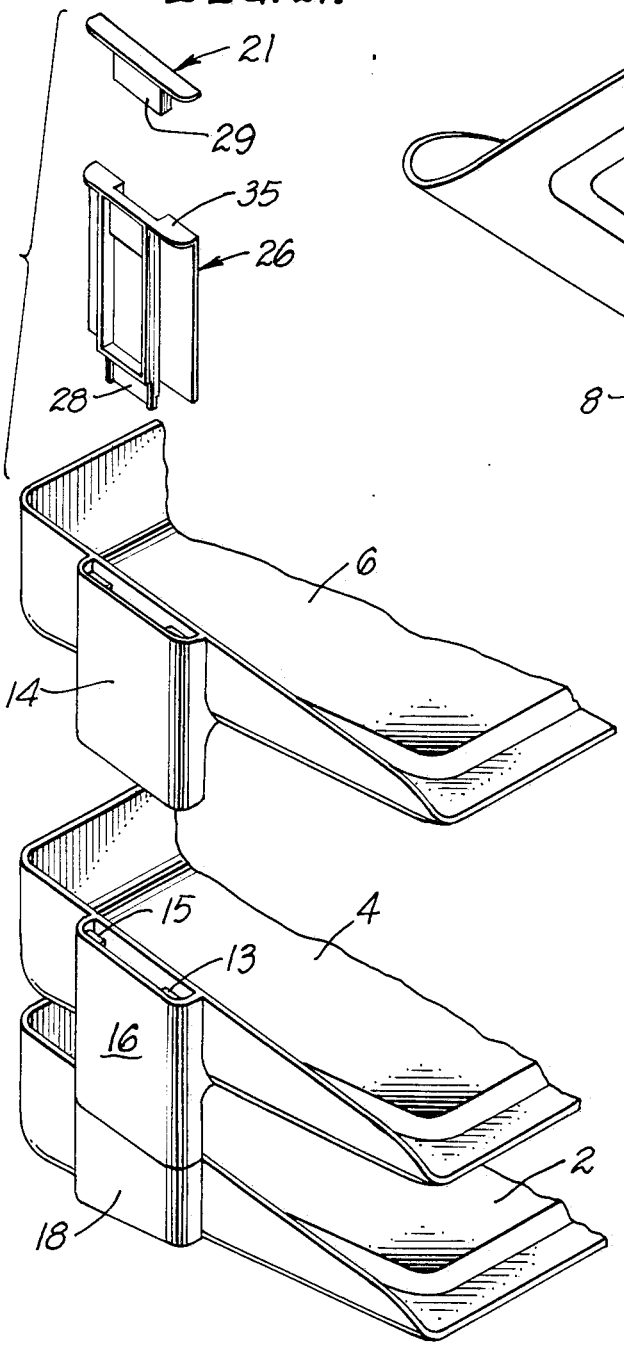
Figure 18:
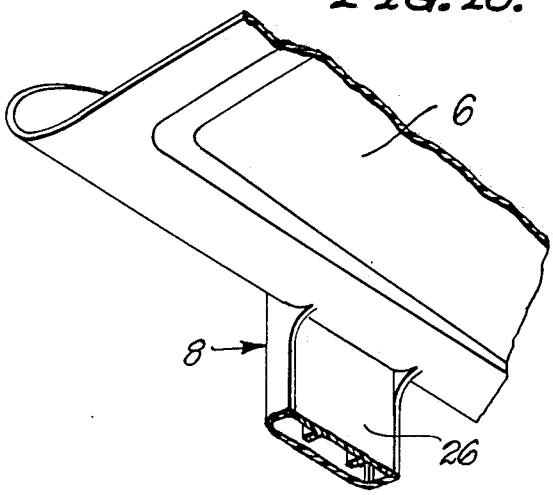

FIGS. 5, 6 and 7 are partial section views of the preceding embodiment taken along the section lines 5—5, 6—6, and 7—7, respectively, in the view of FIG. 4;

FIG. 8 is a partial top elevation view of the illustration in FIG. 3;

FIG. 9 is a partial section view taken along the section lines 9—9 in FIG. 8 showing a portion of the support means;

FIG. 10 is a side elevation of an end cap element used in the preceding embodiment of FIG. 1 and FIG. 11 is a front plan view thereof;

FIG. 12 is a side view of a linking key member used in the support means of the embodiment of FIG. 1 and FIG. 13 is a front plan view thereof;

FIGS. 14, 15 and 16 illustrate a side, front and top elevation views, respectively, of a foot element for the support used in the embodiment of FIG. 1;

FIG. 17 is a partial exploded perspective view of the embodiment of FIG. 1; and FIG. 18 is a partial view of one of the side posts used in the invention as viewed from a position under one of the trays.

The details of a preferred embodiment as illustrated in the various views are not to be regarded as limiting the invention as variations in those designs can be made without departing from the scope of the invention.

DETAILED DESCRIPTION OF A PREFERRED EMBODIMENT

Reference is made to FIG. 1 which shows the stacking tray in a side view. The unit contains three bins or trays 2, 4, and 6 vertically evenly spaced from one another, one on top of or overlying the other, supported by a support member or post 8. The bottom tray contains a simulated pedestal 10 that gives the tray a slight upward tilt. Trays 4 and 6 are also given the same upward tilt in the position maintained by post 8. Feet 1 and 3 support the assembly. As better illustrated in the front view of FIG. 2 each trap forms a bin having back and side walls. A second post 12 is provided on the right side of the trays and together with left post 8 supports the trays as illustrated.

Support post 8 consists of three sections 14, 16, and 18 as indicated by the two horizontal break lines along the post. Likewise right post 12 consists of side post sections 20, 22 and 24. Each of the sections are integrally connected to the sides of the adjoining tray. Thus side post section 14, which forms a side post, is connected to the left side of tray 6; and side post section 20 is integrally connected to the right side of that tray.

The underlying tray 4 is essentially identical in structure to tray 6 and supports side post section 16 on the left side and side post section 22 on the right side. As shown side post sections 14 and 20 extend from the upper portion of the side wall of the tray to a postion underlying and beyond the trays bottom surface, essentially defining a spacing distance between trays 6 and 4. The bottom tray 2 contains side post sections 18 and 24, which form the foundation to the vertical structure. Those side posts are slightly shorter and different in geometry from the side post sections associated with the overlying trays. As shown by the hidden lines within the side post sections 8 and 12 in both FIGS. 1 and 2 the side post section is actually a thin walled structure containing a hollow or passage. That is "thin" in the sense that the thickness is considerably smaller than the length or width of the section.

The internal structure of the side post sections and the linking structure is presented in FIG. 3, which shows in partial section the stacking tray of FIG. 1 taken along the lines 3—3 and is further illustrated in FIG. 4, which shows in partial section view the elements of the side post sections as taken along the section lines 4—4 in FIG. 3. A linking key 26 is positioned within the hollow of side post section 14. The key is of a length that extends from a position adjacent the top end of the post and slightly recessed from that end to a position below that side post section and into the side post section 16 of the underlying tray assembly. For ease of understanding the extending portion of the key is referred to as a key portion and is represented by numeral 28. Likewise an identical key 30, containing a key portion 32, is installed within the hollow or passage of side post section 16 and key portion 32 extends into the passage formed in the lowermost side post section 18.

A cap member 27 is located at the upper end of side post section 14. The cap includes a flange portion that fits the hollow passage and closes the upper end of the section. It also contains a straight depending strip portion 29 that extends downwardly into a space between the key 26 and the left side wall of tray 6. A foot member 31 is located at the bottom of the figures. The foot member contains a flat planar surface closing the bottom of the passage in side post section 18 and also contains a vertically extending strip portion 33 that fits within the passage between the outer wall of the side post section and key portion 32.

Figure 2:
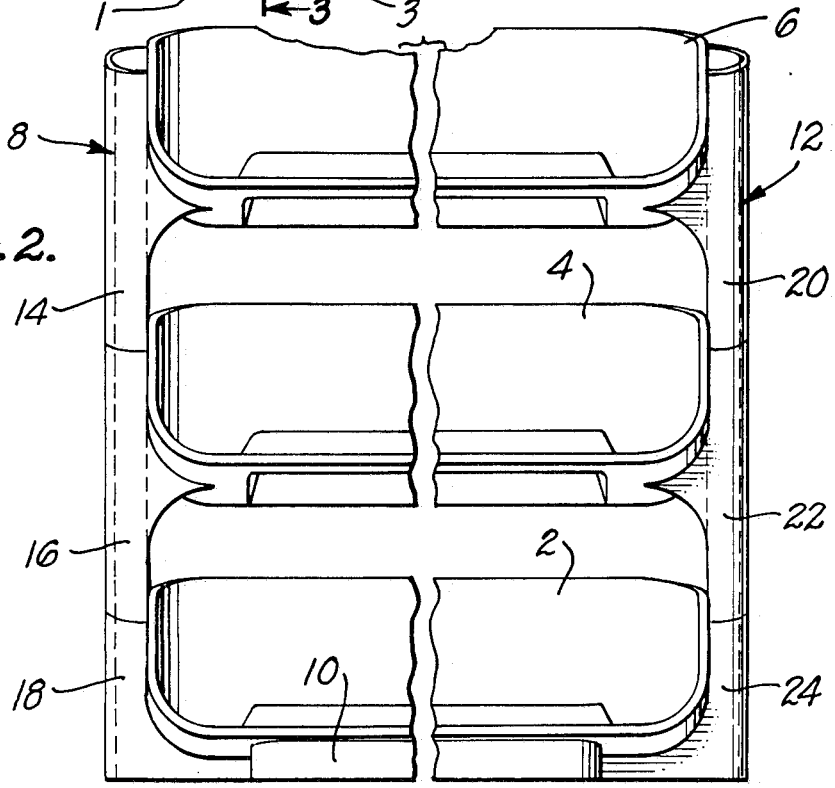
FIG. 2 is a partial front elevation view of the invention shown in FIG. 1.

Although not illustrated in this figure, the right side post sections 20, 22, and 24, illustrated in FIG. 2, are essentially of like construction and includes the corresponding linking keys, differing only in that they are the mirror image of the keys previously described. Likewise side post sections 20 and 24 contain cap members and foot members corresponding to that illustrated and described in connection with the left side post sections.

The person who is less than skilled in the interpretation of section drawings than those skilled in this art should find the views of the elements just described presented in FIGS. 10 through 16 of assistance to help in visualize the details of that structure.

Cap 27 is presented in front view in FIG. 11 and in FIG. 10 that same element is shown from the side as viewed from the left in FIG. 11. The cap contains a flat upper surface 21 and a depending strip portion 29. Integral vertical ribs 23 and 25 are integrally connected with the strip and the under side of surface 21 for strength and support. As shown surface 21 and the bottom edge of wall 29 are inclined from the vertical axis, as represented by ribs 23 and 25, in order to conform to the descending incline of the top edge of the trays as the latter elements are illustrated in FIG. 1.

Key 30 is presented in a front view in FIG. 13. The figure shows flat wall surface portion 34 and the lower key portion 32, the latter of which is more narrow in width than the former. A recess is formed at the key's upper end, which recess contains a bottom wall 36. The width of the recess, which defines a compartment or slot in the upper end of the key, is slightly larger in width than the width of the cap portion 29, illustrated in FIG. 11 and is also slightly larger in width than the key portion 32. This permits insertion of those elements within the slot in a mating engagement as is apparent to the skilled reader. Likewise the incline of the edges of the bottom of the slot formed by the recessed wall and all bottom edges are essentially parallel and are inclined to the vertical axis by the same angle essentially as the top edge of tray 6 illustrated in FIG. 1. The side view of the key presented in FIG. 12 shows a vertical rib 38 which strengthens the element. Another rib, not visible in this view, is spaced from and parallel to rib 38 and is connected to walls 34. Lastly, as was illustrated in FIGS. 3 and 4, two thin metal clips 37 and 39 are preferably attached to the bottom of the key portion of key 30.

The illustration of FIG. 15 shows foot member 31 from the side. The foot member contains a flat bottom surface 41, a flat back wall 33 and two upstanding side walls 43 and 45, the latter of which has an upwardly curving peripherial edge better illustrated in FIG. 14. The geometry of the foot member as depicted in the top view of FIG. 16 is sufficient to close the bottom opening along the underside of the bottom tray; and the curved upstanding walls conform to the underside geometry of bottom tray 2 as viewed in FIGS. 2 and 3 so as to present a solid, unified and sleek appearance. Foot member 31 contains two rubber anti-skid feet applied to the bottom of the foot member.

Turning to the illustration of FIG. 8 a portion of tray 6 and its associated attached right side post section 14 is shown as it may be viewed from the top end in the illustration of FIG. 3. However cap 27 and underlying key 26 are omitted in FIG. 8, which is a condition that exists prior to actual assembly of the elements into a stacking tray. As shown in FIG. 8 the side post section is formed of a "u" channel shape and contains a bottom or side wall portion 5 and two side wall portions 7 and 11 spacing outer side wall 5 from the wall of tray 6. As shown in FIG. 9 side wall 7 extends over to and conforms to the outer peripheral shape of tray 6 to provide support and a pleasing appearance. Two tabs 13 and 15 are supported in the passage. The tabs are attached to the side post section walls. One edge of each tab is spaced a small distance from the outer tray wall to define a narrow slot. As is apparent to those skilled in the art the shape of the key, not illustrated in the figure, is such as to fit though this slot with some frictional coupling and the tabs serve to engage the flange end portion of the key to limit the depth to which the key may be inserted into the side post section.

FIGS. 5, 6 and 7 provide section views at various positions along the length of the left side support post: Specifically FIG. 5 shows the section taken along the lines 5—5 in FIG. 4; FIG. 6 shows the section taken along the lines 6—6 in the cited figure and FIG. 7 is a section taken along the lines 7—7 in FIG. 4. It is unnecessary to repeat the description of the various elements. One should note that the strip 29, which forms a part of cap 27, illustrated in FIG. 3, fits within the slot formed within the upper end of key 26 and the side wall of the tray. The close spacing provides for some frictional engagement. Likewise the key 26 easily fits within the channel like passage formed by the wall of side post section 14. In turn the key portion 28 of the key of trap 6 overlying tray 4 fits within the slot formed in key 30 as shown in FIG. 6. And lastly key portion 32 of the key described in FIG. 6 fits within the slot of foot member 41 located within the side post section of the bottom tray. As shown clips 37 and 39 contain teeth which dig into the key. Thus after the key is inserted with the clips attached, removal and disassembly of the key is most difficult. If easier disassembly is desired, then clips 37 and 39 may be omitted.

The partial exploded view of FIG. 17 is drawn to a reduced scale and shows part of the novel stacking assembly. In essence the foot member, not illustrated is assembled into the underside of the bottom tray within side post section 18 and a key containing the clips described is inserted into side post section 16 of overlying tray 4. Tray 4 is then assembled to the bottom tray. In turn the top tray 6 is placed over tray 4 with the bottom edge of side post section 14 abutting the top edge of side post section 16; key 26 is inserted within the channel passage, with its key portion 28 extending through side post 14 into the top end and into the slot formed within side post section 16. Flange portion 35 of key 26 abuts tab 15 within the side post passage to limit the extent to which the key is inserted. Finally cap 21 is inserted into place on the side post with its extending portion 29 fitted into the slot in key 26. Although I have described the assembly in connection with the left post of the stacking tray it is understood that like elements and assembly are accomplished on the right side as well. The partial perspective view of FIG. 18 shows a portion of tray 6, side post section 8 and a flat wall portion of key 26, which is positioned within the hollow of the side post. As shown the flat wall portion of the key closes the open side of channel shaped side post section 8.

Except for the metal clips and two rubber anti-skid feet, all of the described elements are of plastic, that is, polymer, material. They are formed in the shape illustrated by conventional molding technique known to those skilled in the art. Moreover all of the plastic parts are of the same color and tint so as to provide an appearance that is smooth and luxurious. As was shown in FIG. 18 the flat wall surface of the keys closes the open portion of the channel shaped side post section to disguise the fact that the post is hollow. This gives the illusion that the side post sections are relatively thick pieces reminiscent of fine expensive handcrafted desk accessories. The stacking tray thus presents a well tailored and luxurious appearance.

The foregoing description of the preferred embodiments of the invention is sufficient in detail to enable one skilled in the art to make and use the invention. However, it is expressly understood that the detail of the elements which are presented for the foregoing purpose is not intended to limit the scope of the invention, in as much as equivalents to those elements and other modifications thereof, all of which come within the scope of the invention, will become apparent to those skilled in the art upon reading this specification. Thus the invention is to be broadly construed within the full scope of the appended claims.

What is claimed is:

1. In a stacking tray combination in which a plurality of trays, including an upper most tray and a bottom most tray, are located overlying one another in vertically spaced relationship for providing a plurality paper sheet storage bins and in which each of said trays contains a pair of side post means integrally connected therewith, one of said side post means located on one side of said tray and the other of said side post means being located on the other side of said tray, and in which said side post means of an overlying one of said plurality of trays extends vertically downwardly below the surface of said attached tray and is supported atop the corresponding side post means of an underlying one of said plurality of trays; whereby the stacked side post means on each side of said trays simulate a single long support post; and wherein said each side post means associated with the overlying ones of said trays comprises further:

a hollow channel shaped member having an open top end, and an open bottom end, two side wall portions and a back wall between said ends, said back wall being spaced from the side of the associated tray, said channel member further having an open side portion facing toward said associated tray, whereby the inside hollow of said channel shaped member is exposed to view along a portion of the length of said channel shaped member below the surface of said tray, the improvement therein comprising:

key means located within said side post means, said key means being separate from and insertable within said side post means from said upper end of said side post means, said key means having a protruding portion extending out the bottom end of said side post means with the protruding portion thereof extending into the underlying side post means of an underlying one of said plurality of trays for preventing lateral movement between said trays;

and said key means having a flat surface portion for closing said open side of said channel shaped member and cooperating therewith to simulate a solid post joining said overlying tray with said underlying tray.

2. The invention as defined in claim 1 wherein said protruding portion of said key means is of a predetermined width, said width less than the width of said flat surface portion of said key means.

3. The invention as defined in claim 1 wherein said key means contains an upper end containing a flange portion extending from said flat surface portion essentially perpendicular thereto in a direction toward said tray, and wherein said flange portion contains an opening therein defining a slot passage.

4. The invention as defined in claim 3 wherein said flange portion contains a recess in a peripheral edge and in which said edge of said flange portion abuts said side of said tray to thereby define between said flange and said tray a slot.

5. The invention as defined in claim 1 further comprising:

cap means for closing said upper end of said post means, said cap means having a depending protruding key portion and said protruding portion being positioned within said slot of said key means.

6. The invention as defined in claim 1 wherein said side post means associated with the bottom most tray is a hollow member containing an open upper end and an open lower end; and further comprising:

foot means for closing said opening in said bottom end of said side post means of said bottom most tray, said foot means having an upwardly extending portion insertable within and positioned within said side post means through said bottom end thereof, said extending portion further containing a slot with said slot oriented essentially transverse to said post means.

7. The improved stacking tray combination defined in claim 6, further including:

clip means, said clip means being attached to said protruding portion of said key means for engagement with said slot contained within said foot means.

8. The invention as defined in claim 1 wherein said key means contains a flange and wherein each of said channel members contains a tab for engaging said flange of said key means for limiting the vertical depth position of said key means within said channel member.

9. In a stacking tray combination containing a series of trays overlying one another in vertical spaced relationship and containing support means for holding said trays in the relationship described, the improvement therein wherein at least a portion of said support means comprises:

a hollow channel shaped member, said channel member connected to the side of a tray and further containing an open side portion;

insertable key means positioned within said channel shaped member, said key means containing a key portion for linking said channel member within another portion of said support means and said key means further having a surface for closing the open side portion of said channel shaped member and together with said channel shaped member simulating a thick solid post.

10. The stacking tray combination as defined in claim 9 in which said channel shaped member contains an open upper end and an open lower end and in which said key portion protrudes through said lower end of said channel shaped member, the further improvement therein comprising in combination:

insertable cap means, said cap means containing an upper surface for covering said open end of said channel shaped member and containing a strip portion depending from said upper surface positioned within said channel shaped member.

11. The stacking tray combination as defined in claim 9 in which said channel shaped member contains an open upper end and an open lower end and in which said key portion protrudes through said lower end of said channel shaped member, the improvement therein in which said key means contains a flange portion at the upper end thereof located within said channel shaped member at a position thereof spaced below said channel members upper end, said flange containing a cut away portion defining a slot.

12. The stacking tray combination defined in claim 11 wherein said slotis of a size slightly larger than the largest of said key portion of said key means and said strip portion of said cap means.

13. The stacking tray combination defined in claim 9 further comprising in combination therewith: a second channel shaped member attached to a second tray, said second channel shaped member being oriented overlying said first channel shaped member; and second key means, said second key means being of identical structure to said first key means, said second key means being positioned within said second channel member and having the key portion thereof extending through the bottom end of the second channel member and into the upper end of said first channel member and extending through said slot defined by said first key means.

* * * * *